United States Patent [19]

Quartino et al.

[11] 4,448,183

[45] May 15, 1984

[54] ADJUSTABLE CABLE ANCHORS FOR A COMPOUND BOW

[75] Inventors: Miguel A. Quartino; Earl H. Hoyt, Jr., both of St. Louis County, Mo.

[73] Assignee: Hoyt/Easton Archery Co., Bridgeton, Mo.

[21] Appl. No.: 353,965

[22] Filed: Mar. 2, 1982

[51] Int. Cl.[3] ..... A41B 5/00

[52] U.S. Cl. ..... 124/24 R; 124/DIG. 1

[58] Field of Search ..... 124/23 R, 24 R, 25, 124/86, 80, 90, DIG. 1

[56] References Cited

U.S. PATENT DOCUMENTS

| | | | |
|---|---|---|---|
| 261,610 | 7/1882 | Howe | 124/23 R |
| 3,486,495 | 12/1969 | Allen | 124/DIG. 1 |
| 3,967,609 | 7/1976 | Frydenlund | 124/24 R |
| 3,993,039 | 11/1976 | Groves et al. | 124/23 R |
| 4,112,909 | 9/1978 | Caldwell | 124/23 R |

*Primary Examiner*—Richard J. Apley
*Assistant Examiner*—William R. Browne
*Attorney, Agent, or Firm*—Charles E. Markham

[57] ABSTRACT

The free end portions of the cables of a two-wheel type compound bow are extended to the back of the bow over pulleys rotatably mounted on the wheel shafts, the cable ends are fixed in one end of screws movable longitudinally in bores in adjacent anchor members fixed to the back of the bow and nuts threadedly engaged on the screws and bearing against the anchor members move the screws longitudinally when turned. In a modification anchor members on the front side of the bow are connected to the wheel shafts by flexible loops extending over small pulleys on the shafts and the free ends of the cables are mounted for free rotation in hollow screws threadedly engaged and screw threaded through bores in the anchor members.

3 Claims, 16 Drawing Figures

ADJUSTABLE CABLE ANCHORS FOR A COMPOUND BOW

This invention relates generally to compound archery bows and particularly to means for adjustable anchoring the free ends of the cables of the stringing assembly of a two-wheel type compound bow.

BACKGROUND OF THE INVENTION

There is a need for a conveniently adjustable means for anchoring the free ends of the cables of a compound bow so that symetrical angular positions of the eccentrically mounted wheels at the outer ends of the bow limbs may be easily and precisely attained. Making adjustments of the cable anchors heretofore employed on two-wheel type compound bows was tedious and required relaxing the tension of the cables by flexing the bow limbs. It is also desirable to arrange the lateral spacing of the cable anchors and the eccentric wheels so as to minimize stresses tending to twist the bow limbs when the bow is drawn and to provide an adjustable cable anchoring means in which twisting of the cables is avoided when making adjustments.

OBJECTS OF THE INVENTION

The primary object of the invention is to provide a generally new and improved means for adjustably anchoring the free ends of the cables of a two-wheel type compound bow by which fine adjustments may be conveniently made;

A further object is to provide adjustable cable anchoring means for a two-wheel type compound bow by which adjustments may be conveniently made while the cables are tensioned in a bow strung condition;

A further object is to provide adjustable cable anchoring means by which adjustments may be made when the cables are tensioned in a bow strung condition without twisting the cables and which includes means for locking the anchoring means in an adjusted position;

A further object is to provide adjustable anchoring means for the free ends of the cables of a two-wheel type compound bow positioned so as to minimize twisting of the bow limbs when the bow is drawn.

Further objects and advantages of the invention will become apparent when reading the following description of two forms of the invention in connection with the accompanying drawings.

IN THE DRAWINGS

Figure 1:
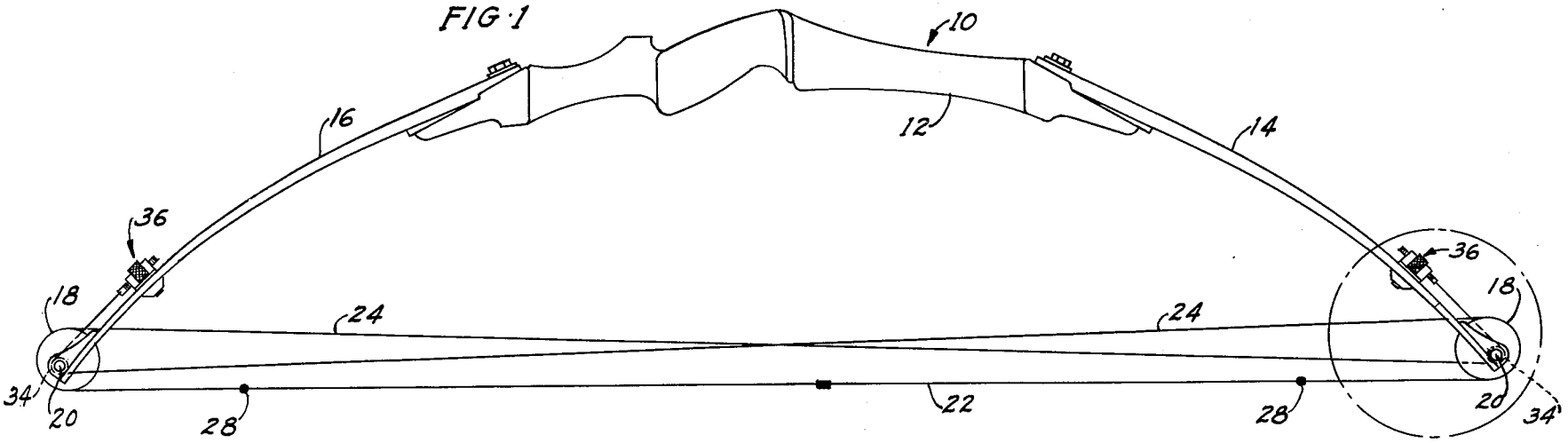
FIG. 1 is an arrow side elevational view of a typical two-wheel type compound bow incorporating adjustable cable anchors constructed in accordance with a first form of the present invention.

DESCRIPTION OF FIRST FORM OF THE INVENTION (Shown in FIGS. 1 to 7 of the drawings)

Referring to FIGS. 1 to 7 of the drawings in more detail; a compound bow generally indicated at 10 has a handle section 12, upper and lower bow limbs 14 and 16, a pair of wheels 18 eccentrically mounted on shafts 20 which are journalled in the outer ends of the bow limbs and a string assembly comprising a bow string 22 and two cables 24. One end of each cable 24 is suitably connected to the bow string at 28 and extends therefrom around a substantial portion of the adjacent wheel 18 in a first groove 30, then through a diametral bore 31 in the wheel to a second groove 32 and thence to a smaller diameter wheel 34 at the other end of the bow and around a portion of a wheel 34 to a free end which is attached to an adjustable anchoring device generally indicated at 36 mounted on the back of the bow limb. The small diameter wheels 34 are preferably grooved and are rotatably mounted on shafts 20 so that adjustment of the anchored free ends of the cables will not effect the angular position of the adjacent eccentrically mounted wheel 18.

The adjustable anchoring devices 36 are mounted adjacent the outer ends of the bow limbs and comprise a body member having a circular base 38 arranged to lie against the bow limb and two spaced integral upstanding portions 40 having aligned smooth bores 42 therethrough. Between the two upstanding portions 40 is a round, knurled nut 44. Extending through the bores 42 and threadedly engaged in round nut 44 is a screw 46. The screw 46 has sufficient length to extend exteriorly of the body at both sides. At one projecting end the screw 46 has a longitudinal bore 48 into which the free end portion of a cable is inserted and fixed therein by any suitable means such as by swaging.

The space between the upstanding portions 40 is slightly greater than the length of round nut 44 and a washer 50 constructed of a low friction thermoplastic material is inserted between one end of the nut 44 and the adjacent face of an upstanding portion 40. The circular base 38 of the body has a central countersunk bore therethrough which receives the head and a portion of the shank of a flat head screw 52 which extends through a bore in the bow limb and is provided with a nut 54. Means for locking the nut 44 in an adjusted position of screw 46 is provided in the form of a set screw 56 threadedly engaged in a screw threaded bore in one upstanding portion 40 and arranged to abut one end of round nut 44.

Figure 4:
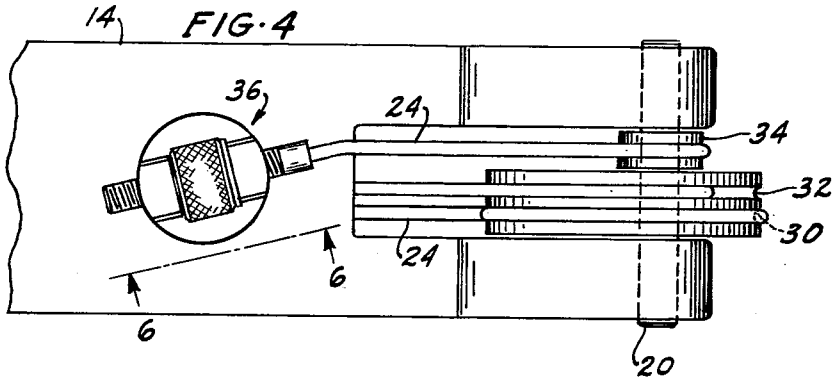
FIG. 4 is an enlarged view of the fragmentary portion of the bow and attached cable anchor enclosed in a dot-dash circle in FIG. 2.
Figure 3:
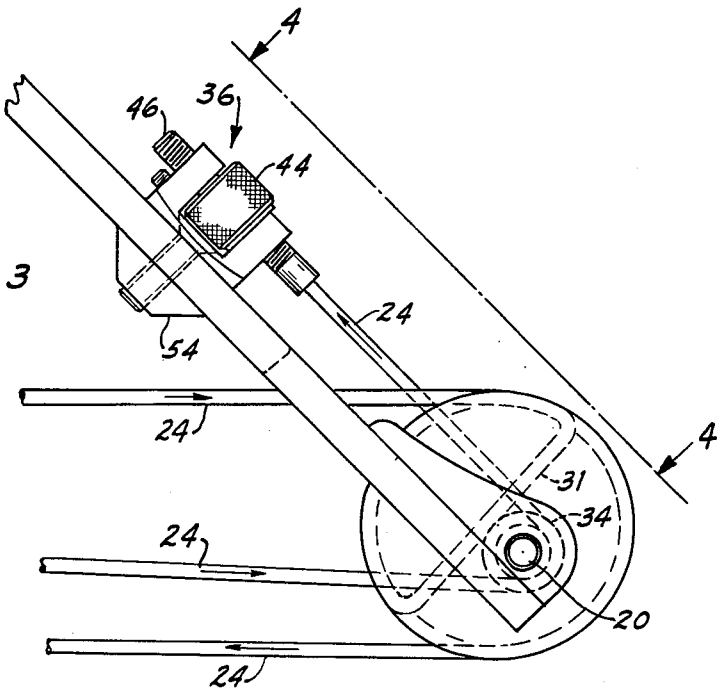
FIG. 3 is an enlarged view of the fragmentary portion of the bow and attached cable anchor enclosed in a dot-dash circle in FIG. 1.
Figure 5:
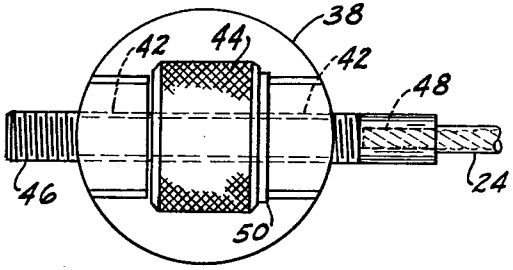
FIG. 5 is a still larger top plan view of one of the adjustable anchors.
Figure 6:
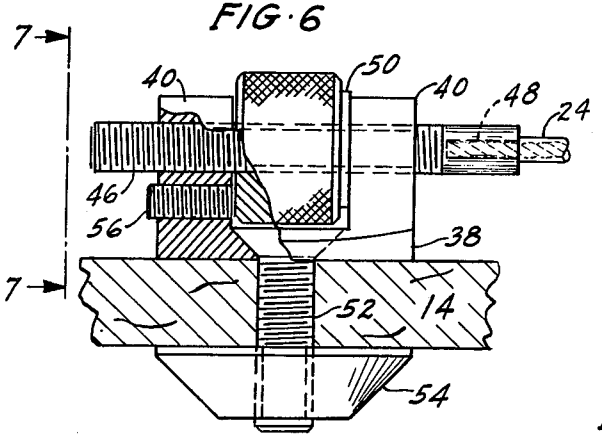
FIG. 6 is a partially sectionalized side elevational view of an adjustable anchor and is taken along line 6—6 of FIG. 4.
Figure 7:
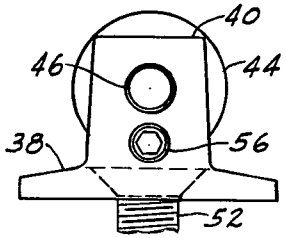
FIG. 7 is an end elevational view of the adjustable anchor taken along line 7—7 of FIG. 6.
Figure 8:
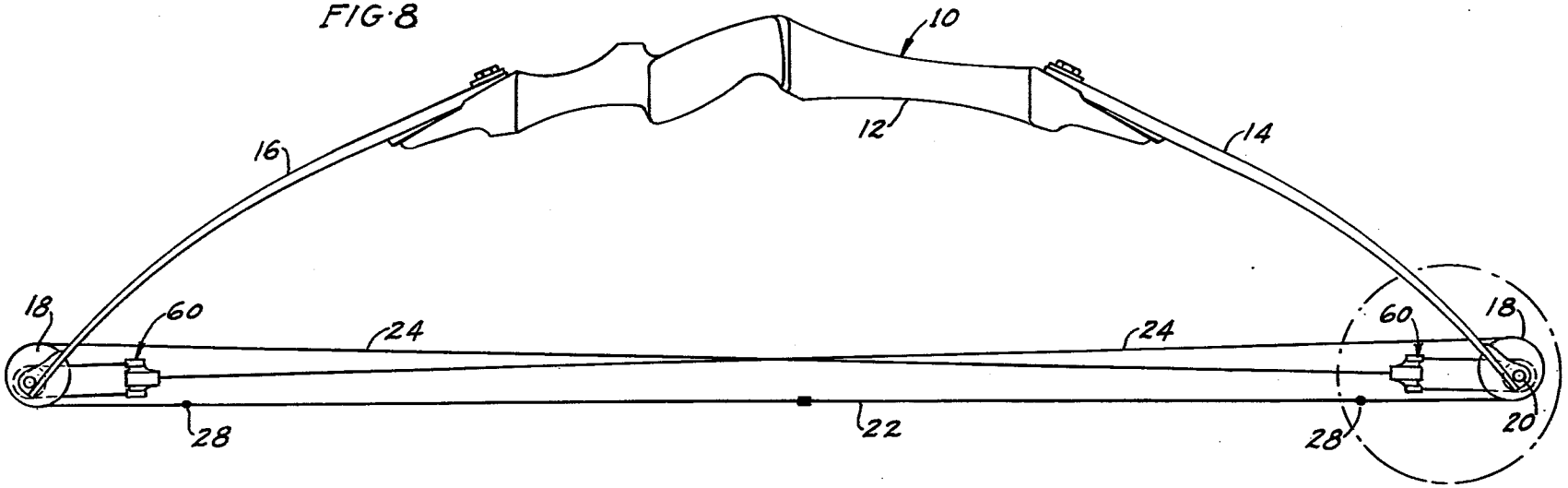
FIG. 8 is an arrow side elevational view of a typical two-wheel type compound bow incorporating a second form of adjustable cable anchoring means constructed in accordance with the invention.
Figure 9:
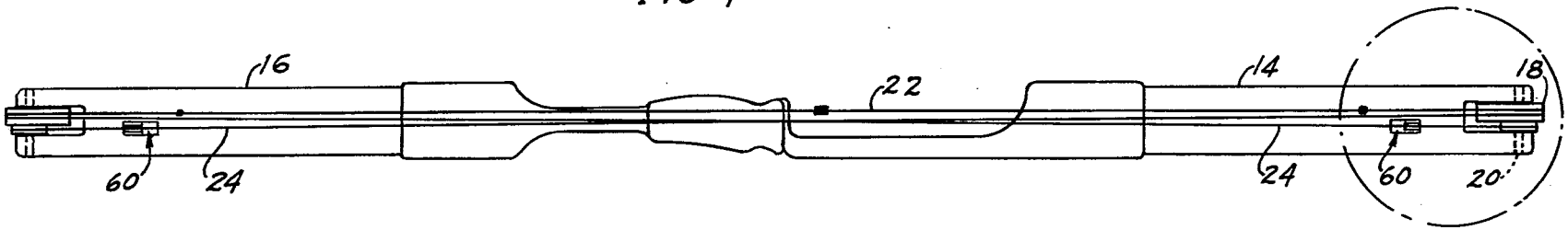
FIG. 9 is a front (string side) elevational view of the bow and adjustable cable anchors shown in FIG. 8.
Figure 11:
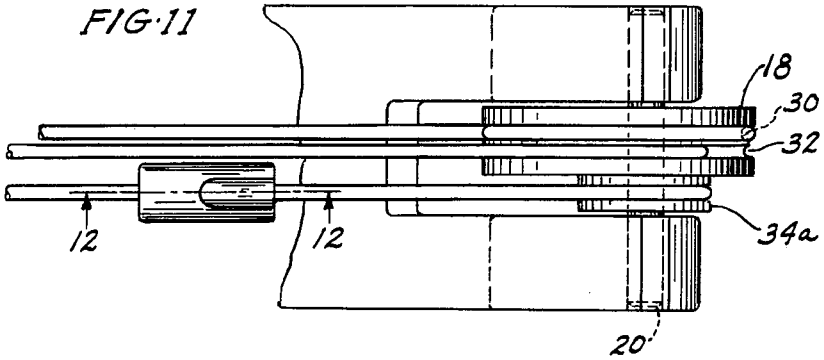
FIG. 11 is an enlarged view of the fragmentary portion of the bow and attached cable anchor shown in dot-dash circle in FIG. 9.
Figure 10:
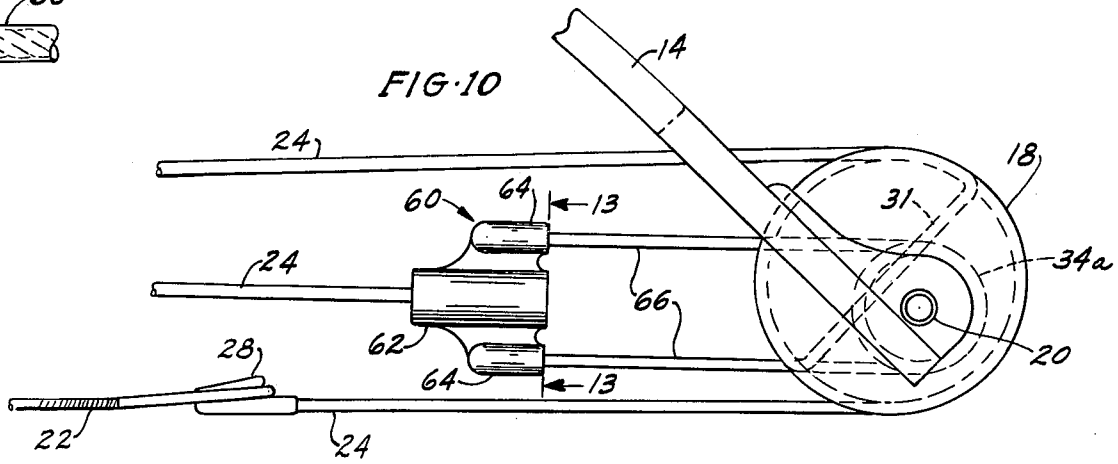
FIG. 10 is an enlarged view of the fragmentary portion of the bow and attached cable anchor enclosed in a dot-dash circle in FIG. 8.
Figure 16:
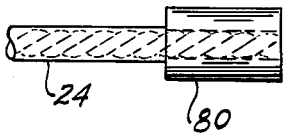
FIG. 16 is an enlarged view of a free end portion of a cable showing the cylindrical head fixed thereon.
Figure 15:
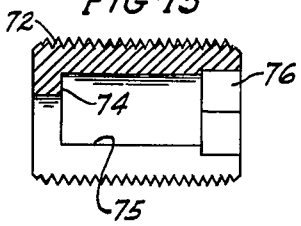
FIG. 15 is a longitudinal cross sectional view of the adjusting screw shown in FIG. 14 and is taken along line 15—15 of FIG. 14.
Figure 14:
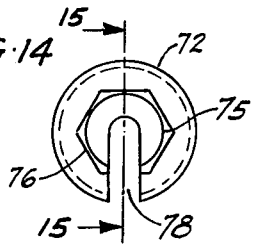
FIG. 14 is an end view of the hollow adjusting screw shown alone.
Figure 12:
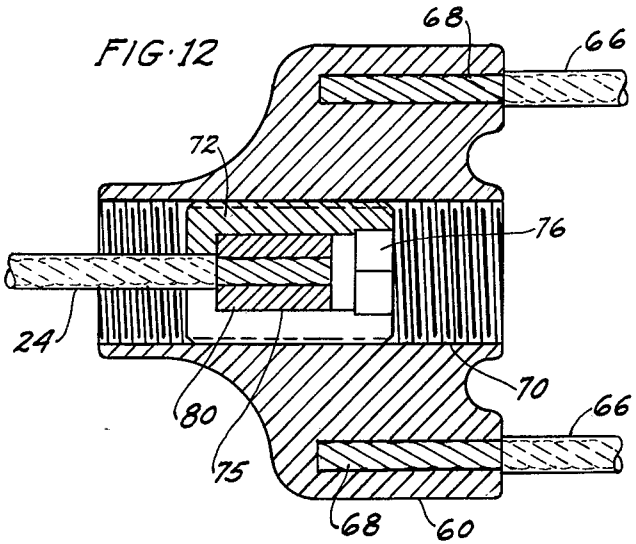
FIG. 12 is an enlarged cross sectional view of the anchor member taken along line 12—12 of FIG. 11.
Figure 13:
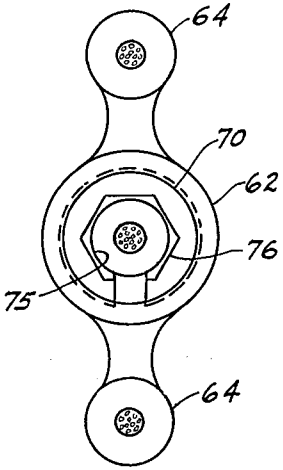
FIG. 13 is an enlarged end view of the anchoring member taken along line 13—13 of FIG. 10.

Referring to FIG. 4 of the drawings, the eccentric wheel grooves 30, which are aligned with the bow string 22, and the grooves in small wheels 34, over which the free end portions of the cables 24 are trained, lie substantially equally spaced on opposite sides of the longitudinal center line of the bow limbs thereby to balance off center stresses on the bow limbs when drawing the bow. The adjustable anchors 36 are preferably mounted on the longitudinal center line of the bow limbs but they may be rotatably positioned about the axis of the single centrally positioned attaching screws 52 so that the end portions of the cables will clear wheels 18.

When making adjustments the round knurled nut 44 is rotated to move screw 46 and the attached end of the cable longitudinally. While the low friction washer 50 prevents rotation of screw 56 and therefore twisting of the cable when rotating the round nut 44 under cable tensioned conditions, assurances that the screw 46 and attached cable does not rotate may be had by grasping a projecting end of screw 46 with one hand while turning the nut 44 with the other. When adjustment has been completed the set screw 56 is turned in against the nut 44 to lock it in an adjusted position.

DESCRIPTION OF A SECOND FORM OF THE INVENTION (Shown in FIGS. 8 to 16 of the drawings)

Figure 2:
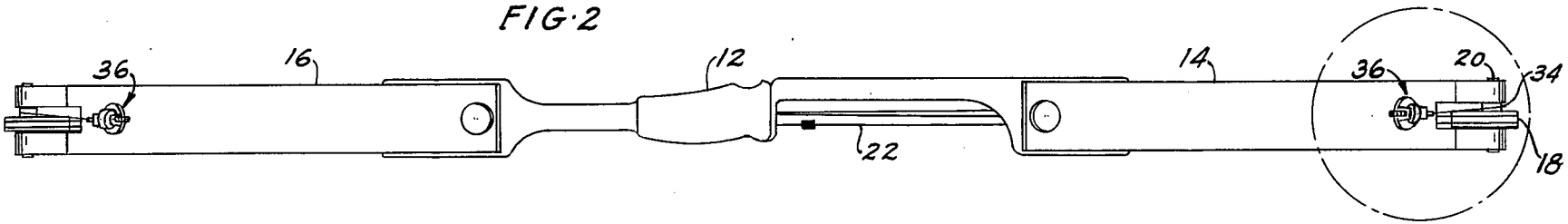
FIG. 2 is an elevational view of the back of the bow with attached cable anchors shown in FIG. 1.

Referring to FIGS. 8 to 16, a two-wheel type compound bow identical to that shown in FIGS. 1 and 2 has adjustable cable anchors generally indicated at 60 positioned on the front or string side of the bow adjacent the outer ends of the bow limbs and operatively connected thereto. The anchors 60 each comprise a molded body having a central cylindrical portion 62 and somewhat smaller parallel cylindrical portions 64 spaced from opposite sides thereof. A loop of flexible stranded cable 66 extending over a small grooved wheel 34*a* mounted on the eccentric wheel shaft 20 has its end portions 68 extending longitudinally into the cylindrical portions 64 and retained therein by molding the cylindrical portions 64 around portions 68 as the body is molded. The anchor bodies are therefore operatively connected to the adjacent outer ends of the bow limbs. A screw threaded bore 70 extending longitudinally through central cylindrical body portion 62 receives in threaded engagement a screw 72.

Screw 72 has a blind longitudinal bore 75 therein terminating at one end at a wall 74 and at its open end in a slightly enlarged hexagonal portion 76. Screw 72 is further provided with a radial slot 78 extending the length thereof and sufficiently wide to receive a cable 24. The free ends of cables 24 have molded thereon cylindrical heads 80 which are entered into bores 75 of screws 72 by first entering an adjacent portion of the cable 24 radially through the slot 78 and then longitudinally entering the head 80. The cylindrical heads 80 are free to rotate relative to the screw 72.

When making adjustments an allen wrench is inserted into the hexagonal portion 76 to rotate the screw 72 and thereby move the screw 72 and operatively connected cable end longitudinally. The use of a low friction washer (not shown) between one end of head 80 and the end wall 74 is contemplated to preclude rotation of the head 80 and therefore the attached cable 24 when the screw 72 is rotated. The grooves 30 in wheels 18 which are aligned with the bow string and the grooves in wheels 34*a* which are aligned with the axes of screws 80 and therefore with the anchored ends of cables 24 are spaced substantially equidistant on opposite sides of the longitudinal center line of the bow limbs.

Other arrangements within the spirit of the present invention may occur to those skilled in the art. For example, the bodies of the adjustable anchors 36 of the first form of the invention, shown in FIGS. 1 to 7, may be modified and operatively connected to the ends of the bow limbs on the string side of the bow by flexible loops of cable extending over small grooved wheels rotatable on shaft 20 as described in the second form. Also, the bodies of the adjustable anchors 60 of the second form of the invention shown in FIGS. 8 to 16 may be modified and mounted on the backs of the bow limbs.

The foregoing descriptions of the two form of the invention are intended to be illustrative, not limiting, the scope of the invention being set forth in the appended claims.

We claim:

1. In a two-wheel type compound bow having two eccentric wheels mounted on shafts journalled in the outer ends of the bow limbs and wherein a pair of cables each having one end connected to one end of a bow string and extending therefrom over an adjacent eccentric wheel and thence along the belly side of the bow to an opposite end thereof to an anchored end; the improvement comprising a pulley mounted for rotation on each of said shafts for the friction free extension of the anchored end portions of said cables to the back side of said bow, and a screw threadedly adjustable anchoring device mounted on the back side of each bow limb, said anchoring devices each comprising a body member mounted in fixed position on the back side of a bow limb spaced from the outer end thereof, each of said body members having an upstanding portion with opposite sides and a smooth bore extending therethrough from side to side, a screw in said bore projecting from opposite sides of said upstanding portion and being guided for longitudinal movement in said bore, said screw having a cable end attached to one projecting end, a nut threadedly engaged on said other projecting end portion of said screw and abutting the adjacent side of said upstanding portion, and a low friction washer between said nut and said upstanding portion whereby said cables may be adjustably anchored without twisting by rotation of said nut.

2. The improvement claimed in claim 1 in which each of said body members has two spaced upstanding portions with an aligned smooth bore extending through said portions in which said screw extends through said bore and projects from opposite sides of said upstanding portions, in which said nut is positioned between said spaced upstanding portions and abuts an adjacent side of one of said upstanding portions, and in which the end of said screw projecting from the opposite side of said one upstanding portion is connected to one end of a cable.

3. The improvement claimed in claim 2 which includes a set screw threadedly engaged in a screw threaded bore extending through one of said upstanding portions and bearing at one end against one side of said nut when tightened thereby to lock said nut in an adjusted position.

* * * * *